United States Patent [19]

Wyatt

[11] Patent Number: 4,758,194

[45] Date of Patent: Jul. 19, 1988

[54] NOVELTY HANDLER-TYPE TOY AND CONTAINERS

[76] Inventor: Ellen Wyatt, 1270 E. 222nd St., Bronx, N.Y. 10469

[21] Appl. No.: 25,157

[22] Filed: Mar. 12, 1987

[51] Int. Cl.[4] ..... A63H 33/00

[52] U.S. Cl. ..... 446/71; 446/75; 206/216

[58] Field of Search ..... 446/71, 75, 76, 81, 446/69, 77; 206/457, 216; 220/23.86

[56] References Cited

U.S. PATENT DOCUMENTS 243,362 6/1881 Crandall ..... 446/69 X 3,583,090 6/1971 Fogarty ..... 446/75

4,279,096 7/1981 Guidry ..... 446/69

*Primary Examiner*—Mickey Yu

*Attorney, Agent, or Firm*—Richard L. Miller

[57] ABSTRACT

This toy is a novelty handler-type that is employed as a decorative amusement device and also serves to store coins paper money and other small objects. Primarily, it consists of a support base which are two cups that are frictionally retained within a larger cup housing. A fluffy cover is also provided and is elastically held to the outside of the cup housing, and paper clips are fastened to the cover by paper holding pins, the paper clips being employed to hold slips of note paper or clippings, etc.

5 Claims, 1 Drawing Sheet

NOVELTY HANDLER-TYPE TOY AND CONTAINERS

BACKGROUND OF THE INVENTION

The instant invention relates generally to decorative and functional toys and more particularly, to a novelty handler-type toy.

Numerous decorative toys have been provided in the prior art that are adapted to serve a specific purpose. For example, U.S. Pat. Nos. 110,114 to Reed; 243,567 to Ireland; 1,513,231 to English; 2,144,751 to Brown; 3,195,265 to Marquez et al; 3,138,249 to Paulini; and 4,447,060 to Guinn; all are illustrative of such prior art. While these units may be suitable for the particular purpose to which they address, they would not be as suitable for the purpose of the present invention as hereafter described.

SUMMARY OF THE INVENTION

A primary object of the present invention is to provide a novelty handler-type toy that will overcome the shortcomings of the prior art devices.

Another object is to provide a novelty handler-type toy, which will serve as amusement device while also being functional and colorful.

An additional object is to provide a novelty handler type toy, which will serve as a container for receiving small objects.

A further object is to provide as a novelty handler-type toy that is simple and easy to use.

A still further object is to provide a novelty handler-type toy that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 2:
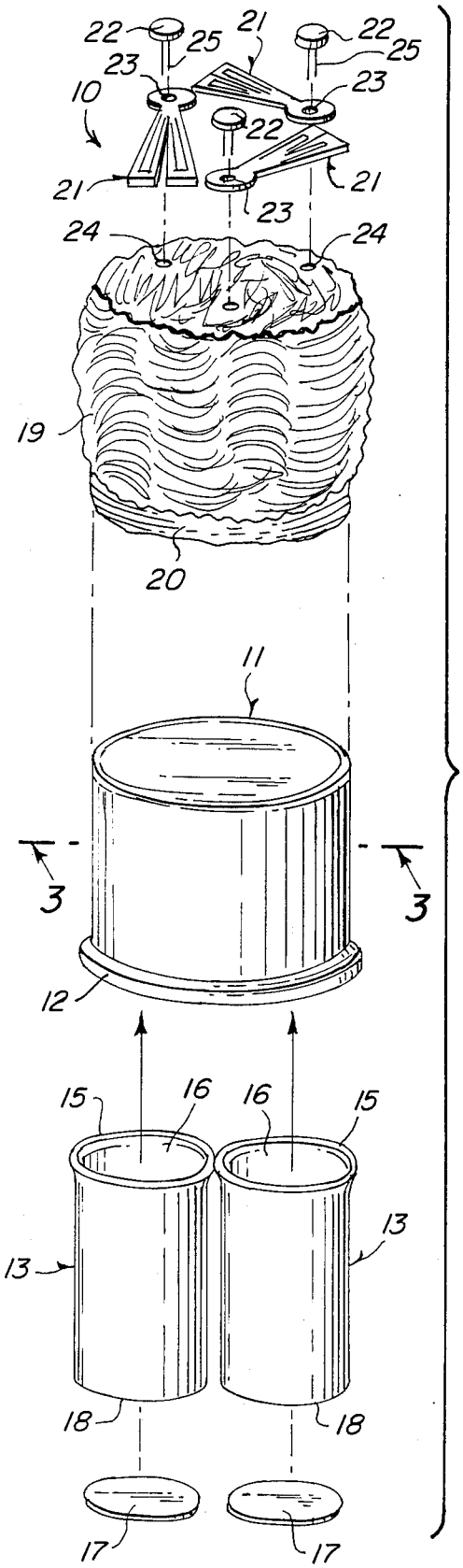
FIG. 2 is a exploded perspective view of the present invention.
Figure 1:
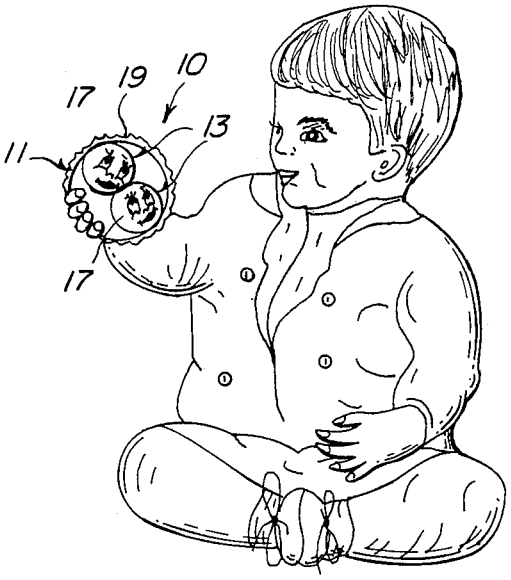
FIG. 1 is a perspective view of a toddler shown holding the invention and illustrating the bottom plan view thereof.
Figure 3:
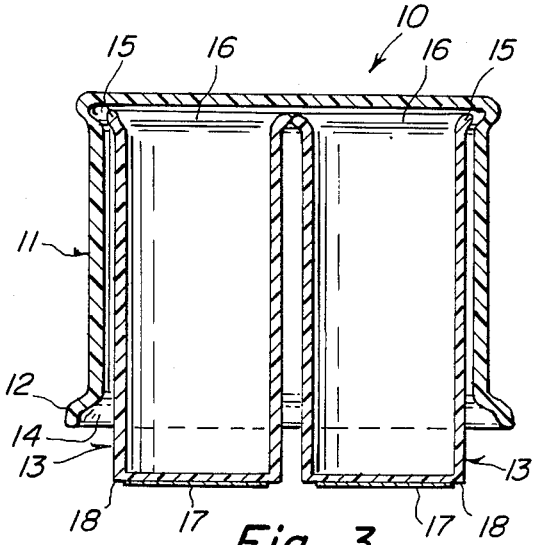
FIG. 3 is an enlarged cross-sectional view, taken along the line 3—3 of FIG. 1.
Figure 4:
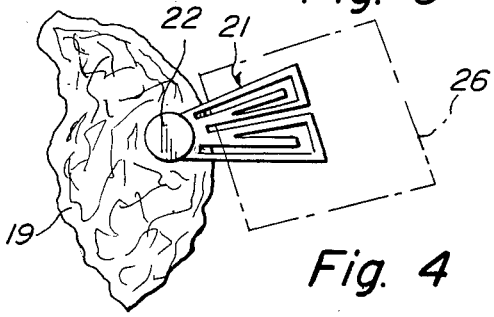
FIG. 4 is a enlarged fragmentary top plan view of the invention, illustrating a piece of paper held thereto, which is shown in phantom.

Turning now descriptively to the drawings, in which like reference characters denote like elements throughout the several views, FIG. 2 more clearly illustrates the full assembly of toy 10, which is shown to include a cup housing 11 fabricated preferably of plastic material. Cup housing 11 is provided with an outwardly flared rim 12, for easy placement of a pair of cups 13 in the opening 14 of cup housing 11. Cups 13 may also be fabricated of plastic and are provided with a similarly outwardly flared rim 15 at their openings 16, which aids in the compressing and ovaling of the rims 15 when cups 13 are entered into housing 11, the result being, that the cups 13 when entered as a pair, will be frictionally retained within the confines of housing 11, by means of rim 15 engaging with the periphery of the cup housing 11. A circular sticker 17 with a smiling face on its outside surface, is suitably adhered to the out side surface of the bottom walls 18 of cups 13, and it is to be noted that cups 13, project from the bottom of the cup housing 11, and serve as base means for the toy 10. A colorful and fluffy cover 19 is provided and includes an elastic 20 as its bottom opening, for rendering cover 19 secure to the outer peripheral surface of cup housing 11, and a plurality of plastic paper clips 21 are secured to the top of cover 19 by metal paper fastener pins 22 that are entered into openings 23 and openings 24 provided through the top of cover 19. The legs 25 of pins 22, are spread apart to retain both the pins 22 and the paper clips 22 to the cover 19, and clips 21 may be employed to hold paper 26 with notes thereon, when desired.

It shall further be recognized, that all of the elements herein described, are of bright contrasting colors.

In use, the cups 13 are removed from the cup housing 11, by grasping with one's fingers and pulling outward, and coins, rolled currency, safety pins, candy, buttons, and any other small articles may be stored within the cups 13. The paper 26 with notes thereon, are easily held in the clips 21, and the cover 19 may be easily removed for laundering when desired.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A handler-type toy, comprising, a cup housing, a pair of cups each having a rim portion received within said cup housing for the storage of paper currency and other articles, a cover received on said cup housing for retaining paper clips, and a sticker respectively secured to a bottom wall of each of said pair of cups, for amusement.

2. A handler-type toy as set forth in claim 1, wherein said cup housing is provided with an outwardly flared rim and said pair of cups are each provided with a flared rim on their open ends and easily insertable into the cup housing, and said flared rim of said cup housing is normally facing downward and spaced from a surface said toy is placed upon, and said pair of cups projects from said cup housing rim and from a base for said toy.

3. A handler-type toy as set forth in claim 2, wherein said pair of cups are removably received within said cup housing and normally face upward, and said sticker is adhesively secured to said respective bottom wall of said pair of cups, and said cups are removable from the confines of said cup housing by grasping bottom portions thereof and pulling said pair of cups out of said cup housing.

4. A handler-type toy as set forth in claim 3, wherein each of said flared rims of said pair of cups is compressed by engagement with the inner periphery of said cup housing, as said pair of cups are resilient, and when entered into said cup housing, are frictionally retained within said cup housing.

5. A handler-type toy as set forth in claim 4, wherein said cover is received on the outer periphery of said cup housing and is held in place by an elastic band secured to an open end of said cover, and paper clips secured to said cover by pins received in openings provided in a top portion of said cover, said paper clips removably receive note paper and other paper.

* * * * *